US006737806B2

(12) United States Patent
Jeong

(10) Patent No.: US 6,737,806 B2
(45) Date of Patent: May 18, 2004

(54) PLASMA DISPLAY PANEL INCLUDING TRANSPARENT ELECTRODE LAYER

(75) Inventor: Jae Heon Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 138 days.

(21) Appl. No.: 09/967,987

(22) Filed: Oct. 2, 2001

(65) Prior Publication Data

US 2002/0043935 A1 Apr. 18, 2002

(30) Foreign Application Priority Data

Oct. 13, 2000 (KR) ..... P2000-60226

(51) Int. Cl.[7] ..... H01J 17/49

(52) U.S. Cl. ..... 313/584; 313/582; 313/585; 313/586; 313/587; 445/24

(58) Field of Search ..... 313/491, 492, 313/582–587; 445/24, 58, 25; 430/312–321

(56) References Cited

U.S. PATENT DOCUMENTS 6,120,975 A * 9/2000 Tokai et al. ..... 430/321
6,137,227 A * 10/2000 Kim et al. ..... 313/582
6,156,433 A * 12/2000 Hatori et al. ..... 428/411.1
6,276,980 B1 * 8/2001 Kim ..... 445/24
6,517,400 B1 * 2/2003 Cho et al. ..... 445/24

FOREIGN PATENT DOCUMENTS

JP 11167874 A * 6/1999 ..... H01J/11/02
JP 2000011898 A * 1/2000 ..... H01J/11/02
KR 1996-0038465 11/1996
KR 2001077468 A * 8/2001 ..... H01J/9/24

* cited by examiner

*Primary Examiner*—Nimeshkumar D. Patel
*Assistant Examiner*—Sikha Roy
(74) *Attorney, Agent, or Firm*—Fleshner & Kim, LLP

(57) ABSTRACT

A plasma display panel and a method of manufacturing the same are provided to prevent data electrode from being reacted with the sodium component contained in a back glass to change its color or to be cut while the data electrodes are formed on a back plate constructing the plasma display panel, thereby improving the quality of the back plate. The plasma display panel includes a front plate constructed in a manner that a plurality of scan electrodes and sustain electrodes, a first dielectric layer and a protection layer are sequentially formed on a glass substrate, a back plate constructed in a manner that a plurality of data electrodes are formed on a glass substrate, barriers formed between the front and back plates to define discharge cells, and fluorescent materials formed between the barriers. The plasma display panel further has a transparent electrode layer that is at least partially formed between the glass substrate of the back plate and the data electrodes. According to the present invention, a supporting force sufficient for preventing cutting and deformation of the data electrodes is provided and the data electrodes are maintained in a uniform shape to improve the quality of the plasma display panel.

23 Claims, 3 Drawing Sheets

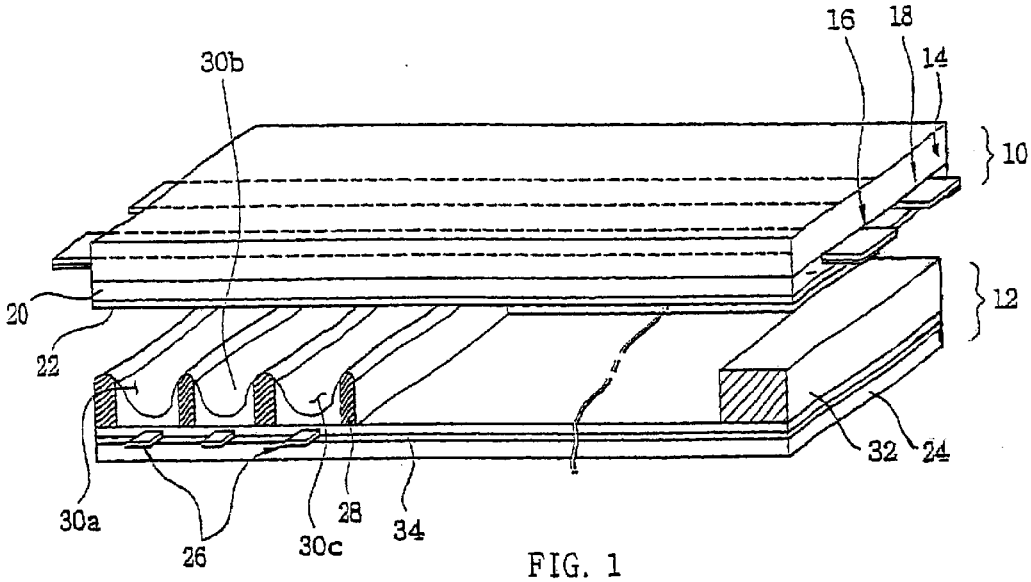
FIG. 1
RELATED ART
FIG. 2
RELATED ART
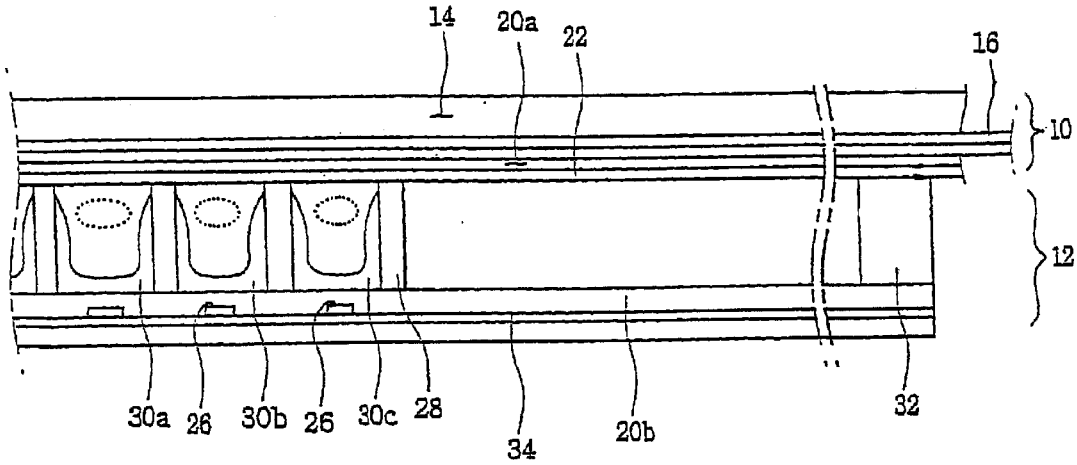

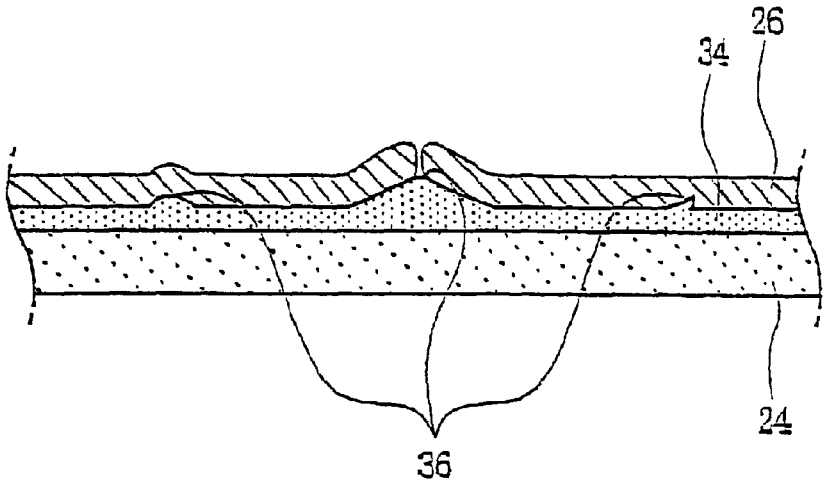
FIG. 3a
RELATED ART
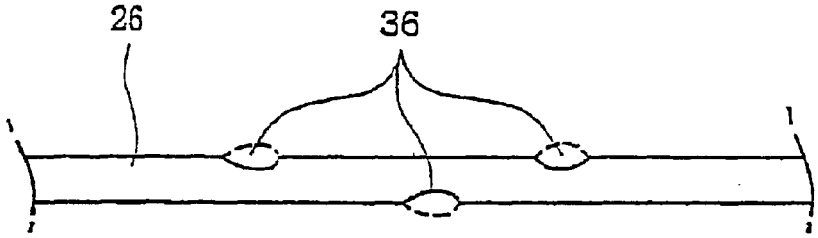
FIG. 3b
RELATED ART
FIG. 4
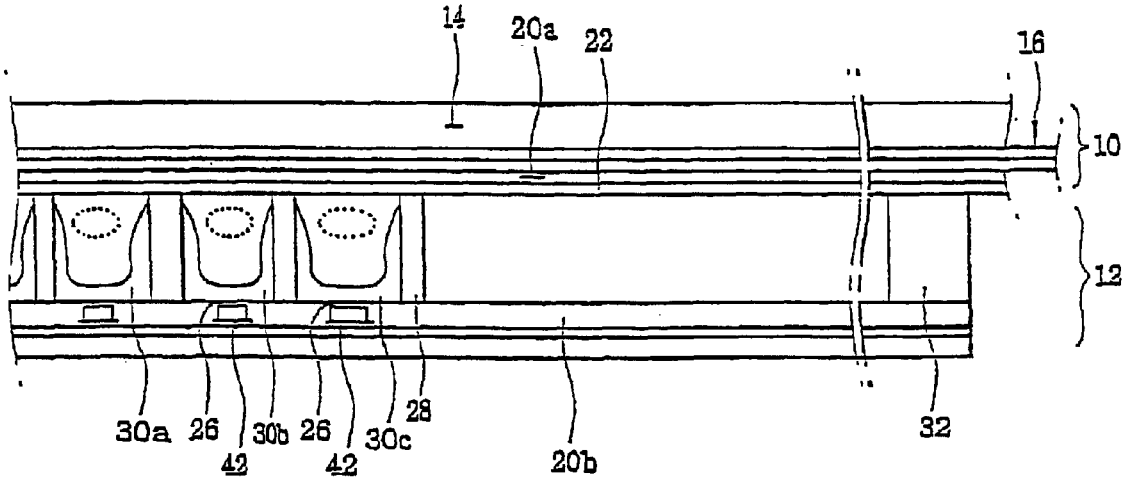

PLASMA DISPLAY PANEL INCLUDING TRANSPARENT ELECTRODE LAYER

BACKGROUND OF THE INVENTION

1. Field of the Invention

The present invention generally relates to a plasma display panel and a method of manufacturing the same and, more particularly, to a plasma display panel and a method of manufacturing the same for preventing data electrode from being reacted with the sodium component contained in a back glass to change its color or to be cut while the data electrodes are formed on a back plate constructing the plasma display panel, thereby improving the quality of the back plate.

2. Description of the Related Art

In general, a conventional display device employing a cathode-ray tube is difficult to manufacture and requires a wide space for its placement, as image display devices become large-sized. In addition, the display device having the cathode-ray tube is so heavy that it is not easy to handle.

In comparison with the conventional display using the cathode-ray tube, a plasma display panel that expresses images using gas discharge phenomenon can easily realize complete flat screen and large-size panel. Furthermore, it is possible to manufacture a thin plasma display panel so that a space for placement of the panel is easily secured. Owing to these advantages, the plasma display panel is being spotlighted as a next-generation display device.

The configuration of the conventional plasma display panel is explained below with reference to the attached FIGS. 1 to 3B. FIG. 1 is a disassembled perspective view showing a part of the conventional plasma display panel having stripe-type barriers, and FIG. 2 is a cross-sectional view roughly showing the combined structure of front and back plates shown in FIG. 1.

Referring to FIG. 1, the plasma display panel has the front plate 10 that is the image-displaying plane of the plasma display panel, and the back plate 12 placed back of the front plate 10. The front and back plates 10 and 12 are combined with each other in parallel, having a predetermined gap between them. The front plate 10 is constructed in such a manner that a plurality of scan electrodes 16 and sustain electrodes 18 are alternately arranged in parallel on one side of a front glass 14 having a predetermined interval, as shown in FIGS. 1 and 2, a pair of each scan electrode 16 and each sustain electrode 18 forming a unit cell. In addition, a first dielectric layer 20*a* covers the scan electrodes 16 and the sustain electrodes 18 formed on the front glass 14, and a MgO protection layer 22 for protecting the dielectric layer from discharge shock is formed on the first dielectric layer.

The scan electrodes 16 and the sustain electrodes 18 are formed in a manner that an ITO (Indium Tin Oxide) transparent conductive layer is formed with a predetermined width on the front glass 14 and a metal electrode made of Ag, for example, is formed at one side of the ITO transparent conductive layer as a bus electrode.

The back plate 12 opposite to the front plate 10 is constructed in such a manner that a plurality of data electrodes 26 are arranged on one side of a back glass 24, perpendicularly intersecting the scan electrodes 16 and the sustain electrodes 18, and a second dielectric layer 20*b* covers the data electrodes 26, as shown in FIGS. 1 and 2. Stripe-type barriers 28 are placed in parallel and extended along the direction of the length of the data electrodes 26.

Each of the barriers is placed between the neighboring data electrodes 26. Fluorescent materials 30*a*, 30*b* and 30*c* with R, G, B colors are sequentially coated between the barriers 28.

The front plate 10 and the back plate 12 are located opposite to each other so that the data electrodes 26 intersect the scan electrodes 16 and the sustain electrodes 18 perpendicularly. These two plates are combined with each other in a manner that their edges are fused to each other using a sealing member 32 configured of frit glass, for example. Here, the data electrodes 26 are conventionally formed through a printing or photography using Ag paste or photosensitive paste containing Ag so that the data electrodes 26 formed of this component are frequently reacted with the sodium component contained in the back glass 24 during heat treatment, to be discolored or cut.

In a conventional technique to solve this problem, an under layer such as $SiO_2$ film having no sodium component is formed between the back glass 24 and the data electrodes 26 and baked to stick on the back glass, and then the data electrodes 26 are formed on the overall surface of the under layer through a conventional method.

However, since the surface of the under layer such as $SiO_2$ film has a lot of protrusions 36, as shown in FIG. 3A, field is concentrated on the data electrodes 26 formed on the under layer to bring about dielectric breakdown and cutting of the electrodes. In addition, it also causes migration of the data electrodes. The protrusions 36 on the surface of the under layer are created based on the state of the plate, grain size of the paste, dispersibility of the paste and so on.

Due to the migration of the data electrodes (Ag electrodes), the under layer cannot support the data electrodes 26 at a high temperature during heat treatment process for baking the data electrodes 26. Thus, the center portion of the data electrodes 26 is inclined toward the back glass 24 and both ends of the data electrodes 26 are relatively edge-curled, in comparison with the center portion, so that discharge voltage applied to the data electrodes is concentrated on both ends of the data electrodes to result in nonuniform discharge voltage, generating dielectric breakdown.

SUMMARY OF THE INVENTION

An object of the present invention is to provide a plasma display panel and a method of manufacturing the same for preventing cutting of the data electrodes due to mutual reaction of the back glass and the data electrodes during heat treatment and for maintaining the data electrodes in a uniform shape.

To accomplish the object of the present invention, there is provided a plasma display panel including a front plate constructed in a manner that a plurality of scan electrodes and sustain electrodes, a first dielectric layer and a protection layer are sequentially formed on a glass substrate, a back plate constructed in a manner that a plurality of data electrodes are formed on a glass substrate, barriers formed between the front and back plates to define discharge cells, and fluorescent materials formed between the barriers, the plasma display panel further comprising a transparent electrode layer that is at least partially formed between the glass substrate of the back plate and the data electrodes.

To accomplish the object of the present invention, there is also provided a method of manufacturing a plasma display panel including a front plate constructed in a manner that a plurality of scan electrodes and sustain electrodes, a first dielectric layer and a protection layer are sequentially formed on a glass substrate, a back plate constructed in a manner that a plurality of data electrodes are formed on a glass substrate, barriers formed between the front and back plates to define discharge cells, and fluorescent materials formed between the barriers, the method comprising the steps of: depositing a transparent electrode layer with a predetermined thickness on one side of the glass substrate of the back plate; patterning the transparent electrode layer into patterns each of which corresponds to the pattern of each data electrode; forming the data electrodes on the transparent electrode layer patterns; and forming a second dielectric layer on the overall surface of the glass substrate including the data electrodes.

BRIEF DESCRIPTION OF THE DRAWINGS

Further objects and advantages of the invention can be more fully understood from the following detailed description taken in conjunction with the accompanying drawings, in which:

FIG. 1 is a disassemble perspective view that roughly illustrates a part of a conventional plasma display panel having stripe-type barriers;

FIG. 2 is a cross-sectional view that roughly illustrates the combined structure of front and back plates of the plasma display panel shown in FIG. 1;

FIG. 3A is a cross-sectional view that roughly illustrates an example of deformation of the data electrodes of FIGS. 1 and 2 due to the layer formed under the data electrodes;

FIG. 3B is a plan view that roughly illustrates the deformation of the data electrodes of FIG. 3A;

FIG. 4 is a cross-sectional view of a plasma display panel according to the present invention.

DETAILED DESCRIPTION OF THE PREFERRED EMBODIMENTS

Figure 5A:
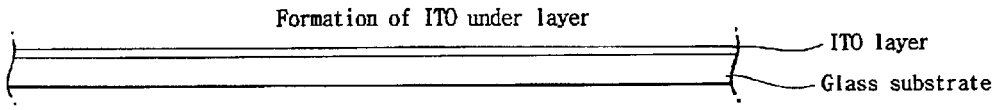
FIGS. 5A to 5E are cross-sectional views that illustrate a process of fabricating the back plate of the plasma display panel according to the present invention.

The present invention will now be described in connection with preferred embodiments with reference to the accompanying drawings.

Referring to FIG. 4, the plasma display panel according to the present invention is constructed in such a manner that a front plate 10 and a back plate 12 are combined with each other, facing each other, having a predetermined distance between them according to barriers 28. The front plate 10 is fabricated in a manner that scan electrodes 16, sustain electrodes 18, a first dielectric layer 20*a* and a protection layer 22 are sequentially formed on one side of a front glass 14. The back plate 12 is constructed in a manner that an ITO electrode pattern wider than the width of the pattern of the data electrodes which will be formed later is formed on a glass substrate by 100–2000 Å approximately, and then the data electrodes are formed thereon. Subsequently, a dielectric layer is formed on the glass substrate including the data electrodes.

A process of fabricating the back plate 12 is explained below in detail with reference to FIGS. 5A to 5E.

Figure 5B:
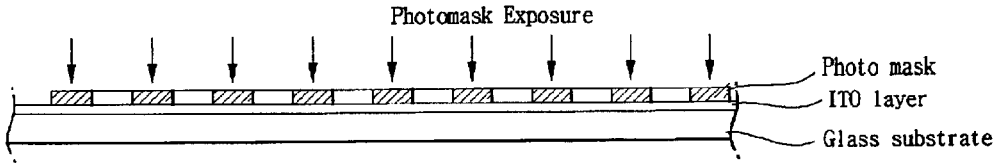

First of all, the ITO electrode layer is deposited on the glass substrate 24 by 100–2000 Å approximately using a sputter, as shown in FIG. 5A. Then, a photosensitive photoresist film (photomask) is formed on the ITO layer as shown in FIG. 5B. Here, the photoresist film has a pattern corresponding to the data electrode pattern which will be formed later.

Figure 5C:
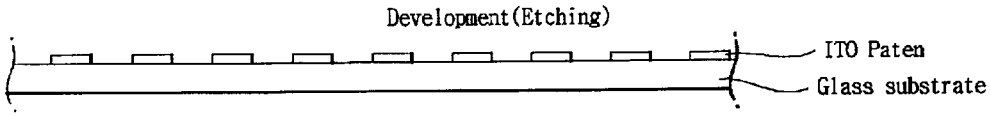
Figure 5D:
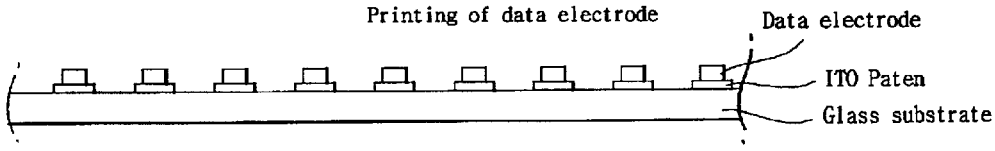
Figure 5E:
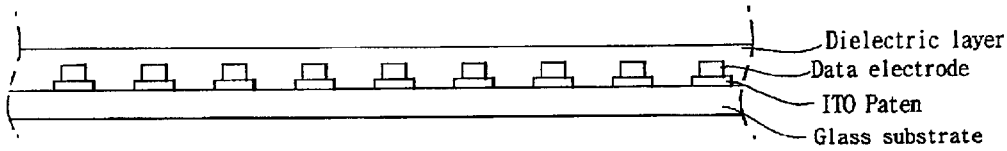

Subsequently, the ITO layer is patterned into an ITO pattern corresponding to the data electrode pattern through exposure and development (etching) as shown in FIG. 5C, and then the data electrodes are formed on the ITO pattern using Ag paste through printing method as shown in FIG. 5D. It is preferable that each ITO pattern is wider than the width of each data electrode. Thereafter, the dielectric layer is formed on the glass substrate on which the data electrodes are formed as shown in FIG. 5E.

A plurality of stripe-type barriers 28 are formed on the dielectric layer 20*b* covering the data electrodes 26 including the ITO pattern 42. Each of the barriers is placed between the neighboring data electrodes. Fluorescent materials of three colors of red (R), green (G) and blue (B) are coated between the barriers to accomplish the back plate 12.

The ITO layer formed as an under layer of the data electrodes 26 of the back plate 12 can be easily formed without requiring an additional baking process in comparison to the conventional under layer such as $SiO_2$ layer. In addition, the ITO layer has durability, heat-resistance and flatness more excellent than those of the conventional under layer 34.

According to the present invention, the ITO transparent electrode layer is formed on the back glass and the data electrodes are formed thereon so that cutting and deformation of the data electrodes are prevented and the data electrodes are maintained in a uniform shape. This results in generation of uniform discharge voltage and stable driving of the display. Furthermore, the data electrodes are not edge-curled during its fabrication process carried out in a manner that Ag paste is coated on the transparent electrode and baked to form the data electrodes. Moreover, the ITO layer does not need a baking process so that it can be formed simply and easily within a short period of process time.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A plasma display panel including a front plate constructed in a manner that a plurality of scan electrodes and sustain electrodes, a first dielectric layer and a protection layer are sequentially formed on a glass substrate, a back plate constructed in a manner that a plurality of data electrodes are formed on a glass substrate, barriers formed between the front and back plates to define discharge cells, and fluorescent materials formed between the barriers, wherein said back plate further comprising a transparent electrode layer that is at least partially formed between the glass substrate of the back plate and the data electrodes.

2. The plasma display panel as claimed in claim 1, wherein the transparent electrode layer is formed in parallel with the data electrodes.

3. The plasma display panel as claimed in claim 1, wherein the transparent electrode layer is an ITO electrode.

4. The plasma display panel as claimed in claim 1, wherein the transparent electrode layer is wider than the data electrodes.

5. The plasma display panel as claimed in claim 1, wherein the thickness of the transparent electrode layer is 100–2000 Å approximately.

6. A method of manufacturing a plasma display panel comprising:

forming a front plate including a plurality of scan electrodes and sustain electrodes, a first dielectric layer and a protection layer on a glass substrate;

forming a back plate including a plurality of data electrodes on a glass substrate; and forming barriers between the front and back plates to define discharge cells, wherein the back plate is formed by:

depositing a transparent electrode layer on one side of the glass substrate of the back plate;

patterning the transparent electrode layer into predetermined patterns;

forming the data electrodes on the transparent electrode layer patterns; and forming a second dielectric layer on the glass substrate including the data electrodes.

7. The method as claimed in claim 6, wherein the transparent electrode layer is an ITO electrode.

8. The method as claimed in claim 6, wherein the thickness of the transparent electrode layer is 100–2000 Å approximately.

9. The method as claimed in claim 6, wherein the width of each transparent electrode layer pattern is wider than that of each data electrode pattern.

10. The plasma display panel as claimed in claim 1, wherein a data electrode is approximately centered on a transparent electrode layer.

11. The plasma display panel as claimed in claim 1, wherein the transparent electrode layer is approximately centered in a discharge cell.

12. The plasma display panel as claimed in claim 1, wherein a discharge cell includes at most one transparent electrode layer per discharge cell.

13. The plasma display panel as claimed in claim 1, wherein a discharge cell includes at most one data electrode per discharge cell.

14. The plasma display panel as claimed in claim 1, wherein the transparent electrode layer is formed in an orthogonal direction to the direction in which scan and/or sustain electrodes are formed.

15. The plasma display panel as claimed in claim 1, wherein the transparent electrode layer is formed in a direction parallel to the direction of a barrier.

16. The method as claimed in claim 6, wherein the data electrodes are formed approximately centered on the transparent electrode layer patterns.

17. The method as claimed in claim 6, wherein the transparent electrode layer is patterned to center the transparent electrode layer patterns in a center of a discharge cell.

18. The method as claimed in claim 6, wherein a discharge cell has at most one patterned transparent electrode per discharge cell.

19. The method as claimed in claim 6, wherein a discharge cell includes at most one transparent electrode layer per discharge cell.

20. The method as claimed in claim 6, wherein the transparent electrode layer is patterned to be in a direction approximately perpendicular to scan and/or sustain electrodes.

21. The method as claimed in claim 6, wherein patterning the transparent electrode layer does not require a separate baking process prior to forming the data electrodes.

22. The method as claimed in claim 6, wherein the patterning of the transparent electrode layer patterns the transparent electrode layer to be in a direction approximately parallel to a barrier.

23. A plasma display panel, comprising:

a front substrate;

a plurality of scan and sustain electrodes formed on the front substrate;

a back substrate opposite the front substrate;

a plurality of transparent electrodes formed on the back substrate; and a plurality of data electrodes formed on the plurality of transparent electrodes, wherein the plurality of transparent electrodes are approximately orthogonal to the plurality of scan and sustain electrodes.

* * * * *